United States Patent [19]

Suda

[11] 4,043,767

[45] Aug. 23, 1977

[54] CENTERLESS GRINDING MACHINE USING TANGENTIAL-FEED METHOD

[76] Inventor: Minoru Suda, 220-1, Ohdo, Yono, Saitama, Japan

[21] Appl. No.: 714,989

[22] Filed: Aug. 16, 1976

[30] Foreign Application Priority Data

Sept. 20, 1975 Japan ..... 50-113132

[51] Int. Cl.[2] ..... B24B 5/22; B24B 5/32

[52] U.S. Cl. ..... 51/103 WH; 51/215 CP; 51/215 UE

[58] Field of Search ..... 51/103 R, 103 WH, 82 R, 51/88, 215 CP, 215 H, 215 UE

[56] References Cited

U.S. PATENT DOCUMENTS

| | | | |
|---|---|---|---|
| 1,814,363 | 7/1931 | Booth | 51/103 WH |
| 1,850,372 | 3/1932 | Binns | 51/103 WH |
| 2,397,131 | 3/1946 | Decker | 51/88 X |
| 2,439,225 | 4/1948 | Scrivener | 51/103 WH |

*Primary Examiner*—Harold D. Whitehead
*Assistant Examiner*—Nicholas P. Godici
*Attorney, Agent, or Firm*—George B. Oujevolk

[57] ABSTRACT

A centerless grinding machine of tangential feed type including a work holder which is divided into a workrest for holding a workpiece as well as for loading and unloading same to and from grinding position, and a workrest holder for supporting the workrest during grinding operation as well as for giving depth of cut to the workpiece. The workrest and the workrest holder are reciprocatively moved by their independent driving mechanisms and adapted to be combined for giving depth of cut to the workpiece held in the workrest during grinding operation. Immediately upon completion of the grinding operation, the workrest is separated from the workrest holder and returned upwardly for unloading the workpiece from the grinding position. After the next workpiece to be ground is set in the workrest, the workrest is again moved into grinding position so that centerless grinding operation is carried out repeatedly, to thereby shorten the time necessary for loading and unloading the workpiece to and from the grinding position as well as to present a fully automatic centerless grinder.

11 Claims, 14 Drawing Figures

$$R_1 = \frac{W \sin(\pi/2 - \tau + \phi) \sin(\beta + \phi)}{\sin(\pi/2 - \tau + \phi) + \cos(\beta + \phi)}$$

CENTERLESS GRINDING MACHINE USING TANGENTIAL-FEED METHOD

BACKGROUND OF THE INVENTION

In centerless grinding, workpieces in the form of right cylinder are ground by the through-feed method, in which workpieces placed between a grinding and a regulating wheels on a workrest are fed automatically in the axial direction, whereby the axes of the grinding and the controlling wheels are held at a predetermined distance during the grinding of workpieces. In case of the centerless grinding of workpieces in the form of, for example, a motorshaft, an axially stepped cylinder, or the workpieces, in the form of bolt and valve stem with the head at the end of the shaft, loaded workpieces are ground by the in-feed method, in which the depth of cut of a grinding wheel on the workpiece is controlled by the in-feed of the regulating wheel to the grinding wheel. With the tangential feed method, a workpiece between a grinding and a regulating wheels is fed in the tangential direction of the circumference of the grinding wheel, so as to place the workpiece in the grinding position and to give the depth of cut of the grinding wheel on the workpiece.

A workpiece ground the tangential feed method has the same shape as a workpiece ground by the in-feed method. As compared with the in-feed method, the tangential feed method has the following advantages, the tangential feed movements provide for the setting of the depth of cut on the workpiece by means of a fixed distance between the axes of the grinding and regulating wheels, as well as providing for the loading and unloading of the workpiece at the workrest. For the reason as stated above, the setting of the depth of cut is thus easily made with high accuracy. Moreover, the machine can be simply constructed for fully automatic operation, and the cycle time for the centerless grinding of each workpiece is remarkably reduced. Nevertheless, in case of the centerless grinding machine employing the tangential feed method, which is different from by the other centerless grinding machines which employ the through-feed or the in-feed method, it is difficult to solve such problem as the lowering in the rigidity of the workrest, and also to realize the mechanism of the workrest movement which occurs during the grinding operation.

The inventor has therefore developed the tangential feed method for centerless grinding, and has studied the feed mechanisms, whereby the workrest is placed between the grinding and the regulating wheels, and is rotated or reciprocated with unequal velocity when the workpieces are loaded, ground and unloaded.

As a result, in case of the rotating workrest in the form of a thin cylinder with a number of holding positions of the workpiece on the cylindrical circumference, the grinding operation is continued completely and automatically with an considerable saving of time. However, the rigidity of thin cylindrical workrest, which is fixed to the side of the rotating disk, is insufficient and as the cylindrical workrest is made for the given workpiece with a fixed dimension and shape, the use of this machine is limited to specific workpieces. Also, the roundness of the ground workpieces does not sufficiently approach a true circle, because the workpieces are ground by passing them through the line which joins the centers of the grinding and regulating wheel axes.

The centerless grinding employing tangential feed method, in which the workrest is reciprocatively moved, is advantageous in that it is easy to select the geometrically optimum grinding conditions, so as to correspond to the centerless grinding machine when grinding workpieces of different dimensions and shapes then in the case of a rotating workrest. As for the saving of grinding time, is is difficult to achieve the unequal velocity of the reciprocating workrest with a suitable driving mechanism in accordance with the loading, grinding and unload of the workpiece.

In another case, at the Nomoco Co. in West Germany, the centerless grinding machine employing the tangential feed method with a reciprocating workrest was developed several years after the experiments of the inventor. In this case, in order to solve the technical difficulty of achieving reasonable unequal velocities of the workrest, and especially to avoid the effect of the lowering in rigidity of the workrest using the tangential feed movement of the workrest for the loading, grinding and unloading of the workpiece, the grinding and regulating wheels are arranged on the side wall of the upright column of the machine whereas the grinding and regulating wheels are usually set firmly on the bed of the machine. Also, the workrest is arranged on the horizontal guide way, which is perpendicular to the side wall of the upright column, and the direction of the movements of the workrest for loading and grinding is applied against the cutting direction of the grinding wheel. During the centerless grinding, in conventional centerless grinding machines, the workrest supports the workpiece in a wedge-like space, which is formed by the cylindrical outer surfaces of the grinding and regulating wheels, and prevents the tendency of the workpiece to pull away the wedge-like shape in opposition to the cutting force.

In this case, however, the workrest, in contrast to the conventional machine, pushes the workpiece towards the cutting force in the wedge-like space, and so, by exceeding the depth of cut or at the beginning of the grinding or workpieces which are not completely round, the workrest disturbs or prevents the smooth rotation of the workpieces, so that the contact pressure of the workrest on the workpiece must be kept elastic in the direction of the feed movement.

With the constructional feature of this centerless grinding machine, the workrest does not require a high degree of rigidity, during grinding, and the driving movements of the workrest, according to the loading, grinding and unloading of the workpiece can easily be controlled by the unequal velocity and the risk of a break-down in the grinding wheel can also be avoided, even though the rigidity of the workrest may not be sufficient in the directon of the feed movement.

In this centerless grinding machine, as mentioned above, during centerless grinding, the supporting conditions of the workpiece and the construction of the machine, where the grinding and regulating wheels are arranged vertically on the wall of the column, have the following defects, so that it is difficult to obtain a centerless grinding machine with maximum stability, high rigidity and efficient operative characteristics, that is:

1. As mentioned above, during centerless grinding, by the fact that the workrest must maintain elastic contact with the workpiece and there is a lack of rigidity in the direction of the feed movement, the setting of the heavy grinding condition is impossible for the grinding operation with high efficiency. Also, becaue of the excessive depth of cut, the rotational movement of the workpiece lacks smoothness, and because of the harmony of the periodical displacement of the workrest, the formation of the workpiece in a shape not completely round is accelerated and the workpiece is formed to an unround shape called "Greichdick" having three or other odd number convex portions in the circumference.

2. The construction, in which the grinding and regulating wheel heads are arranged on the side wall of the upright column, is inferior to the conventional machine construction, in which the grinding and regulating wheel heads are arranged on the bed, from the viewpoint of the stational and dynamic rigidity and stability of the machine. Therefore, because of the increased depth of cut or extended grinding width, the dimensional accuracy and accuracy of shape decrease as the grinding and regulating wheel spindles are displaced at the increased grinding resistance, and also the realization of a high degree of productivity is very difficult.

3. As the aforesaid constructional principles for centerless grinding machine are disregarded the method of driving and the precise settings of the grinding and regulating wheels and the ways of operating the different centerless machine parts are limited. Therefore, the production of a high performance centerless grinding machine with high operational and stable characteristics is very difficult.

SUMMARY OF THE INVENTION

It is therefore a primary object of the invention to solve the aforesaid problems encountered with the centerless grinding machine of conventional tangential feed method, and to provide a centerless grinding machine of high performance of this kind, wherein a work holder of reciprocative type consists of two separate parts, i.e. a workrest and a workrest holder, where the workrest engages in the loading and the unloading of the workpiece, while the workrest holder, during the grinding of the workpiece, supports said workrest and gives the feed movement to the workrest for the depth of cut of the workpiece with the tangential feed movement. The workrest and the workrest holder are reciprocatively moved under the same cycle by their independent mechanisms, respectively, and during the grinding operation, the workrest is combined with the workrest holder, continuously gives the depth of cut to the workpiece according to the tangential feed movement of the workrest holder. The workrest is separated from the workrest holder immediately upon completion of grinding operation and is returned upwardly for the unloading of the workpiece. During the reciprocative movement of the workrest, the workrest holder returns slowly upwards for a short distance to support the workrest during the grinding. According to the grinding operation, the reciprocative movement of the workrest and workrest holder are repeated quickly for each of the workpieces which are to be ground, and thus the time necessary for the loading and unloading of the workpieces is shortened. Also, during the grinding of the workpieces, the workrest is supported firmly by the workrest holder for a stable grinding operation, and the accuracy of the ground workpieces is maintained at a high degree. For the reason as mentioned above, according to the invention, it is easily possible to obtain a centerless grinding machine of high performance and fully automatic operation. The present invention will now be described in more details with reference to the accompanying drawings which show by way of example preferred embodiments of the invention.

DESCRIPTION OF THE PREFERRED EMBODIMENTS

Figure 1A:
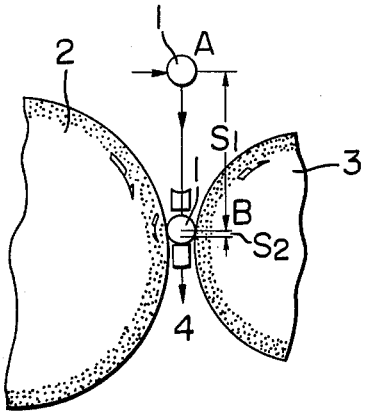
FIGS. 1 (*a*), 1(*b*), 1(*c*) is an explanatory view showing the loading of a workpiece to grinding position, depth of cut at the time of grinding and the unloading of the workpiece after grinding, at a work holder of the centerless grinding machine according to the invention.
Figure 1B:
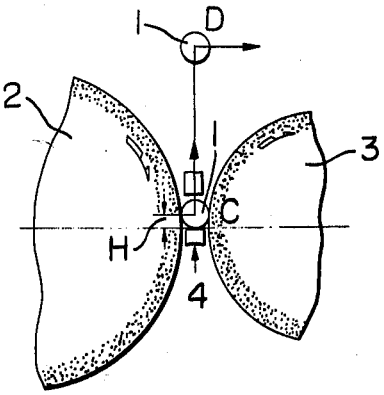
Figure 1C:
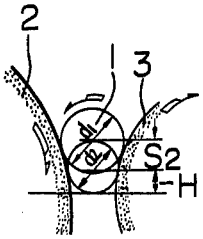

FIG. 1 is an explanatory view showing the relation between the feeding movements in time and the displacements in length of the workpiece, at loading, grinding and unloading by the centerless grinding machine using the tangential feed method. In FIG. 1, shown at 1 is a workpiece, 2 is a grinding wheel, 3 is a regulating wheel, 4 is a workrest, $S_1$ is the distance for the loading of the workpiece to the grinding position, and $S_2$ is the feeding distance for the depth of cut of the grinding wheel on the workpiece. H is the distance from the line, which connects the center of the grinding wheel shaft and the center of the regulating wheel shaft, to the center of the workpiece, which is called "supporting height" in the existing centerless grinding. In the centerless grinding using the tangential feed method, the workpiece, shown in FIG. 1(*a*), is fed from the upper point A to the grinding point B at the distance $S_1$ in the common tangential direction of the circumferences of the grinding wheel and the regulating wheel. The workpiece is then fed gradually in the same direction at the distance $S_1$, shown in FIG. 1(*c*), so as to provide the depth of cut of the grinding wheel on the workpiece. The workpiece is ground in the space, which is limited to the wedge-like shape formed by the circumferences of the grinding wheel and the regulating wheel.

In such case, the value $\Delta d = d_1 - d_2$ of the depth of cut on the workpiece is set by the feeding distance $S_2$, the radiuses of the grinding and controlling wheels and the workpiece supporting height H at the end of the grinding process. Then, at the end of the grinding, the workpiece is fed out from the grinding place C, as shown in FIG. 1(*b*), and is returned to the upper position D.

In the grinding operation using such tangential feed method for centerless grinding, in order to shorten the time necessary for loading and unloading the workpiece, and also to decrease the idle running time of the machine, the workrest holding the workpiece must operate at unequal velocity in the direction of the feeding movement.

Figure 2:
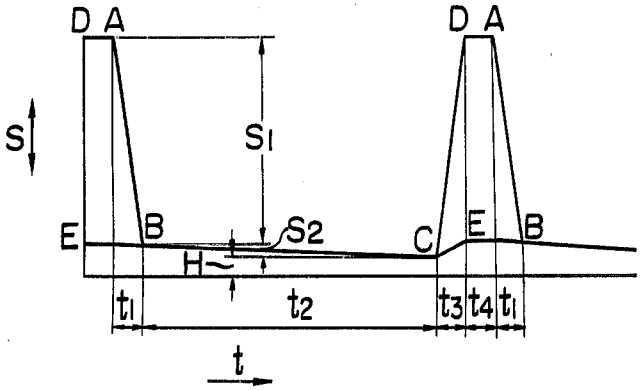
FIG. 2 is an explanatory view showing the relationship between the loading and unloading of a workpiece to and from grinding position at the work holder, as shown in FIG. 1, and the time necessary for the respective movements, wherein the relationship between the respective movements and the time in the present invention, in which the work holder is divided into a workrest and a workrest holder, is also shown.
Figure 3A:
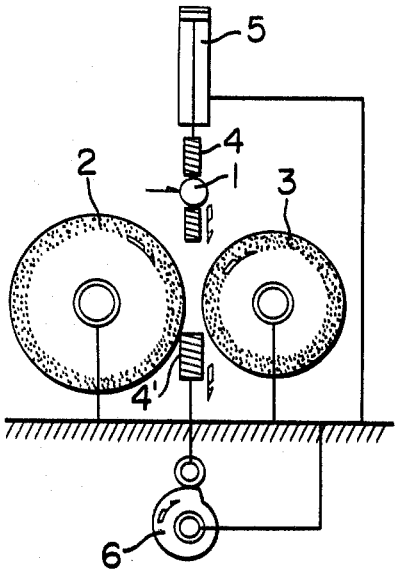
FIGS. 3(*a*), 3(*b*), 3(*c*), 3(*d*) is an explanatory view showing the method of driving the workrest and the workrest holder in the present invention.
Figure 3B:
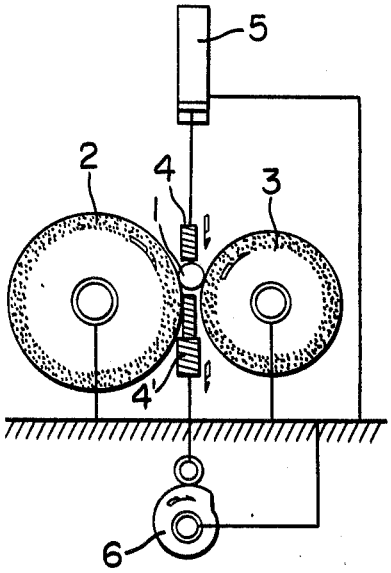
Figure 3C:
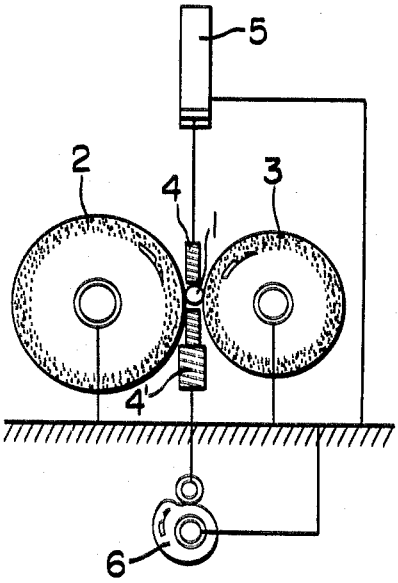
Figure 3D:
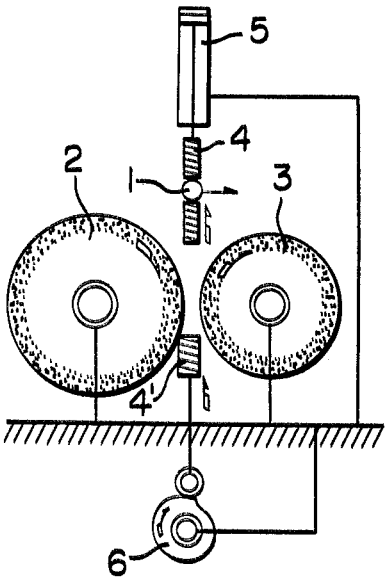

FIG. 2 shows the relation between the movement S of the workrest in the direction of the tangential feed, which is repeated for the grinding of the each workpiece, and the time, which is required for the grinding of the workpiece. In the figure, during the feeding movement of the workpiece which is fed to the workrest from the position A to the position B, at the distance $S_1$, the time $t_1$ elapses, and during the feeding displacement $S_2$ required for the necessary depth of cut on the workpiece, which is guided by the workrest, the time $t_2$ elapses for the distance B–C. During the displacement of the ground workpiece for the distance $S_1 + S_2$ by the return from the position C to the position D, the time $t_3$ also elapses. While the ground workpiece is fed out from the workrest and then the new workpiece is fed into the workrest, the time $t_4$ elapses.

Likewise, the workrest repeats the reciprocative displacement with unequal velocity for the grinding of each workpiece. Also, the displacement distance $S_1$, shown in FIG. 2, for the feeding of the workpiece from the place A to the place B is 300–500 mm, and the displacement distance $S_1$ for the depth of cut, during the grinding of the workpiece is 1–1.5 mm in the existing centerless grinding machines.

As for the decrease in the idling time of the machine, the relation between the time $(t_1 + t_3 + t_4)$ and the time $t_2$ is chosen, for example, according to the following equation $(t_1 + t_3 + t_4) / (t_2) = 1/3$. Then the velocity of the workrest for the loading and unloading during time $t_1$ and $t_3$ is 2000–3000 times greater than for the depth of cut during the time $t_2$.

Therefore, because of the great difference between the distance and the velocity, it is very difficult to obtain the reciprocating movement of the workrest, with the unequal velocity, by means of a simple driving mechanism. That is, under the load due to the grinding force and to the precise feeding movement necessary for the depth of cut, it is appropriate to drive the workrest with a machine element, i.e. a screw, cam, gear etc. directly. However, it is impossible to achieve a reasonable mechanism for acceleration of 2000–3000 times or a reduction of 1/(2000–3000). By direct drive with a cylindrical air or oil motor, the quick changes of the workrest speeds is easily achieved, but while during the grinding of the workpiece, it is not appropriate to maintain the rigidity and the accuracy of position in accordance with the gradual feed movement of the workrest.

With the tangential feed centerless grinding method of the invention, as described above, the workrest and the workrest holder are driven separately. The workrest is driven quickly for the loading and unloading of the workpiece with a long stroke, and while the workrest holder is driven rather gradually for a shallow depth of cut in grinding. As for the grinding process, the workrest and the workrest holder are combined and move together at the velocity of the workrest holder.

Therefore, in FIG. 2, the workrest repeats the reciprocating movement along the bended line A B C D A and the workrest holder repeats its movement also along the bent line B C E B, and during the aforesaid movements, at the section B C, the movement of the workrest holder is combined with the movement of the workrest.

FIG. 3 (*a*), (*b*), (*c*), (*d*) shows the driving mechanisms of the workrest and the workrest holder, in which 1 shows a workpiece, 2 shows a grinding wheel, 3 shows a regulating wheel, 4 shows a workrest, 4' shows a workrest holder, 5 shows an air or oil cylindrical motor for the driving of the workrest 4, and 6 shows a cam for the driving of the workrest holder.

At (*a*) in FIG. 3, the workrest 4 shows the beginning of the movement for the loading of the workpiece 1 to the grinding position after the workpiece is fed into the workrest, and the workrest holder 4' also shows the beginning of the downward movement.

At (*b*), the workrest 4 with the workpiece 1 is fed downward quickly to combine with the workrest holder, and the workpiece is fed into the position for the beginning of the grinding.

At (*c*), following the movement of the workrest holder, the depth of cut is given to the workpiece, and the grinding of the workpiece is finished at the end of the downward movement of the workrest holder.

At (*d*), when the workpiece finishes the grinding, the workrest returns quickly upwards.

As mentioned above, the loading and unloading into the grinding position, and tangential feed for the depth of cut are caused by the unequally moving reciprocation of the workrest and workrest holder. The loading and the unloading of the workpiece at the grinding position occurs quickly as a result of the work of the cylindrical motor 5, and the feeding movement for the depth of cut is given by the gradual driving of the cam 6, the workrest and the workrest holder being in contact.

During the grinding of the workpiece, the contact between the workrest and the workrest holder is kept under the pressure, which is produced by the motor 5, and the grinding force acts downwards on the workrest for keeping the contact between the workrest and the workrest holder.

Therefore, during the grinding of the workpiece, the rigidity of the workrest in the direction of the feeding movement is firmly maintained, and though the supporting part of the grinding workpiece is divided into the workrest and the workrest holder, and are driven individually by the separate driving mechanisms, the rigidity of the supporting part is maintained in general.

Figure 4:
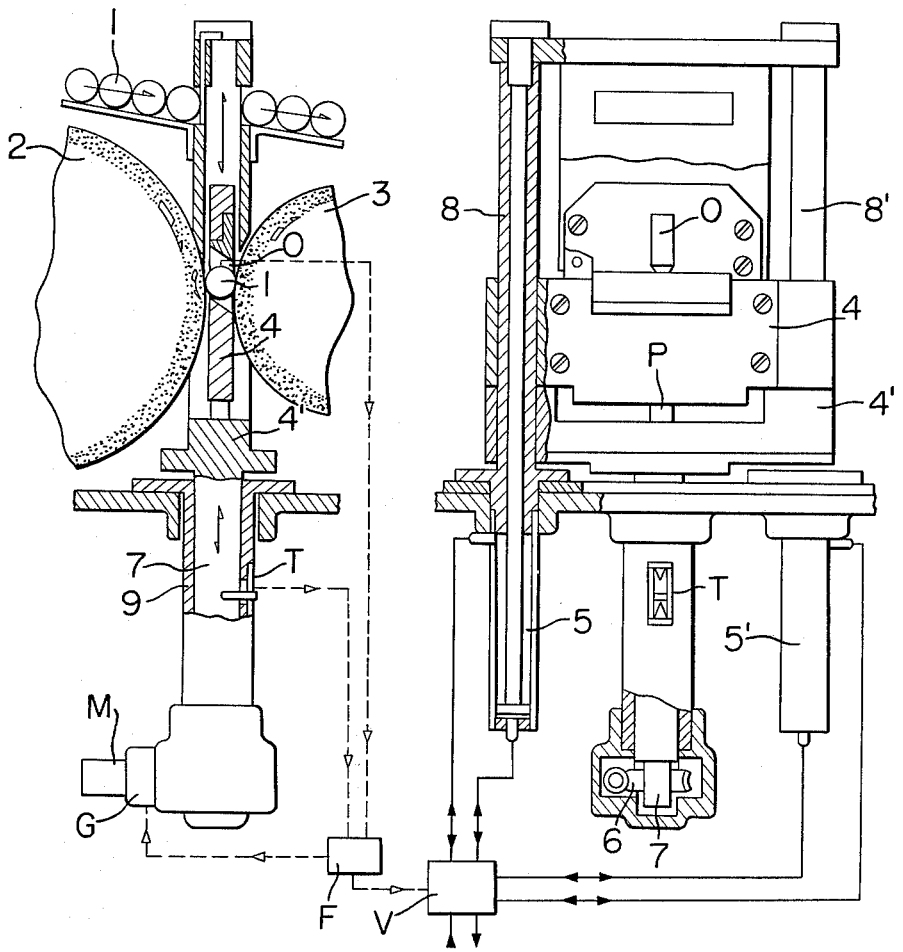
FIG. 4 is a view of an embodiment of the centerless grinding machine of tangential feed type according to the invention, showing the method of driving the work holder which is divided into the workrest and the workrest holder.

FIG. 4 shows an example of the application of the invention in which, 1 is a workpiece, 2 is a grinding wheel, 3 is a regulating wheel, 4 is a workrest, 4' is a workrest holder, 5 and 5' are driving motors for the workrest, 6 is a driving worm wheel for the workrest holder, 7 is a cylindrical part of the workrest holder, 8 and 8' are guide posts for the workrest 4 and the workrest holder 4', 9 is a guide cylinder for the part 7, which contains the part in which the worm wheel 6, an electric motor M and a gear box G for the driving of the worm wheel 6 are arranged. Shown at T is a micro-switch for the checking of position of the up and down movements of the workrest holder, O is an in-process gauge, F is an amplifier for the micro-switch T and the in-process gauge O, V is an exchanging valve for the air or oil used in the cylinder 5 and 5' and P is a damper for the shock force generated by the high speed contact between the workrest and the workrest holder.

As shown in FIG. 4, as the driving motor for the workrest and the driving mechanism for the workrest holder are arranged inside the fed of the machine, and the workrest and the workrest holder are arranged together with the post on the bed, the construction of the centerless grinding machine is simply realized, and yet the machine has excellent operational and performance characteristics.

That is, in the conventional centerless grinding machine using the tangential feed method, as the feed movement for the grinding of the workpiece, and the loading and the unloading of the workpiece at the grinding place are effected by the reciprocative or revolutionary movement of the workrest using the simple driving method, it has been difficult to obtain the necessary unequality in the movement of the workrest, and also to maintain sufficient rigidity of the workrest.

According to the invention, as shown in FIG. 4, the workrest 4, which is so constructed as to support the workpiece with the workrest holder 4', is guided firmly by precise fitting to the guide post 8 and 8', which stand right on the bed and are close both sides of the grinding wheel. The workrest holder 4' is also guided firmly by precise fitting to the guide posts 8, 8' and into the cylinder 9.

In the feeding direction, the rigidity of the workrest holder 4' for the grinding force and the pressure of the motor 5 and 5', which act through the workrest 4, is sufficiently maintained with the screw fitted to the worm wheel 6. The shock which acts in the case of the loading of the workpiece to the grinding position by the fast contact of the workrest 4 with the workrest holder 4' can be soothed by the shock absorber P, as shown in FIG. 4.

According to the centerless grinding machine of the invention, as shown in FIG. 4, the workpieces are fed into the workrest from the magazine directly, and the workpieces, which have completed the centerless grinding process, are also fed out from the workrest to the magazine directly. Therefore, the mechanism of the loading and unloading of the workpieces to the grinding position is simple in construction, as compared with the conventional centerless grinding machines, and so, a fully automatic centerless grinding machine with high performance can also be easily constructed. That is, the workpiece fed into the grinding position is ground with the depth of cut of the grinding wheel on the workpiece given by the tangential feed of the workrest holder. The position of the workrest holder for the end of the grinding process is checked with the micro-switch T, as shown in FIG. 4. The electric current given by the checking of the micro-switch is amplified by the amplifier F and operates the magnetic clutch of the gear box G, for the change of the driving direction of the worm wheel 6. With the change of the turning direction of the worm wheel 6, the workrest holder begins the movement for the upward return.

At the same time, the electric current, given by the checking of the micro-switch T and amplified by the amplifier F, operate the electromagnetic valve V for the change of the current direction of the compressed air or oil. With the change of direction of the fluid current for the cylindrical motor 5 and 5', the workrest returns upwards quickly.

During the movement of the workrest holder in the upward direction, as the workrest has returned to the upper end, the ground workpiece is fed out from the workrest to the magazine, and the next workpiece is fed into the workrest from the magazine for grinding.

When the upper limit of the movement of the workrest holder is checked with the micro-switch T, the electric current operates again the magnetic clutch of the gear box G and the electromagnetic valve V, so as to move downwards the workrest holder gradually and the workrest quickly. After the workrest contacts with the workrest holder, the workpiece is ground in the workrest by the feeding movement of the workrest which is given by the driving of the workrest holder.

Therefore, in accordance with the method of the invention it is possible to grind the workpiece effectively because of the decreased idling time of the centerless grinding machine, and also to construct easily a fully automatic centerless grinding machine.

In grinding workpieces, in general, as the feeding movement for the depth of cut of the grinding wheel on the workpiece is repeated precisely for the grinding of every workpiece, it is very difficulat to maintain the dimensional accuracy within a high degree of tolerance, since the depth of cut differs for each workpiece, according to the wear of the grinding wheel, the increase in temperature of the grinding wheel spindle and the bearings during the grinding process of the machine, and according to the difference of the stock of the removal etc.

For the reason as stated above, during the grinding, the inprocess-gauge is used, so as to finish the grinding process within the limit of the predetermined dimension of the workpiece. In the centerless-grinding process, however, the application of the inprocess-gauge is difficult as compared with cylindrical or internal grinding machines, and in order to apply it, special means are selected according to the dimension and the shape of the workpieces.

By using the centerless grinding machine of the invention, the inprocess-gauge O, as shown in FIG. 4, is attached to the workrest 4, and can be adapted easily to workpieces, which have rather complicated shapes and which were ground by the conventional in-feed or tangential feed method. That is, during the grinding, the diameter of the workpiece is measured continuously with the inprocess gauge O. With the coincidence of the dimension of the grinding workpiece diameter with the predetermined dimension of the inprocess gauge, the electric information current is transmitted to the amplifier F, and the electric current amplified by the amplifier operates the electromagnetic clutch of the gear box G and the electric valve V, and the finish of the grinding of the workpiece and the feeding out of the workpiece from the grinding position are performed at the same time.

Moreover, by using the tangential feed centerless grinding machine of the invention, as shown in FIG. 4, the tangential feed movement for the depth of cut is not the same as the actual movement for the depth of cut. For example, in the construction of the dimensions of usual centerless grinding machines, for the predetermined stock of removal within a dimeter of 0.01 mm, the movement of the tangential feed is 0.05–0.10 mm. Therefore, by using the centerless grinding process, the dimensional accuracy necessary for the feeding movement is reduced to 1/5–1/10. Thus, at the finish of the grinding process for each workpiece, by using the micro-switch T for the dimensional check of the end position for the downward movement of the workrest holder, and alos by the use of the in-process gauge O, the dimensional check for the movement of the workrest is obtained easily with a high degree of precision. As a result, by the centerless grinding machine of the invention, even though the grinding process is fully automatic, the dimensional accuracy of the ground workpieces can be precisely obtained.

Figure 5A:
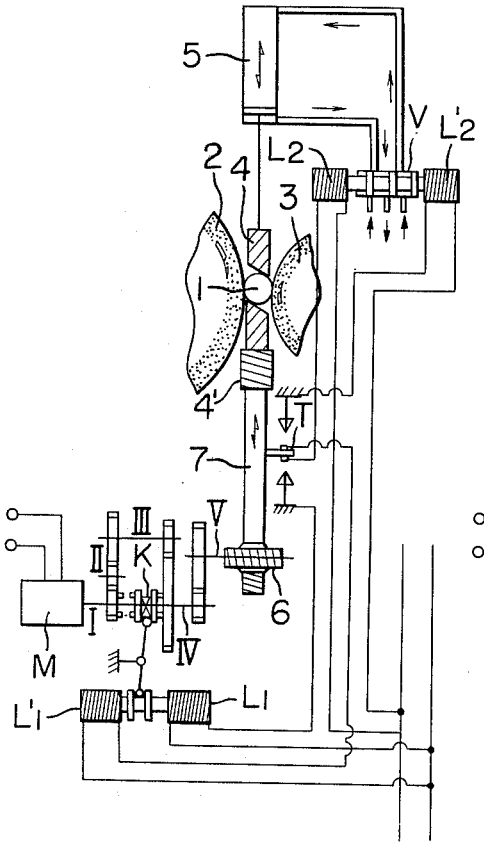
FIGS. 5(*a*), 5(*b*) is a view showing the driving system of the centerless grinding machine of tangential feed type according to the invention.
Figure 5B:
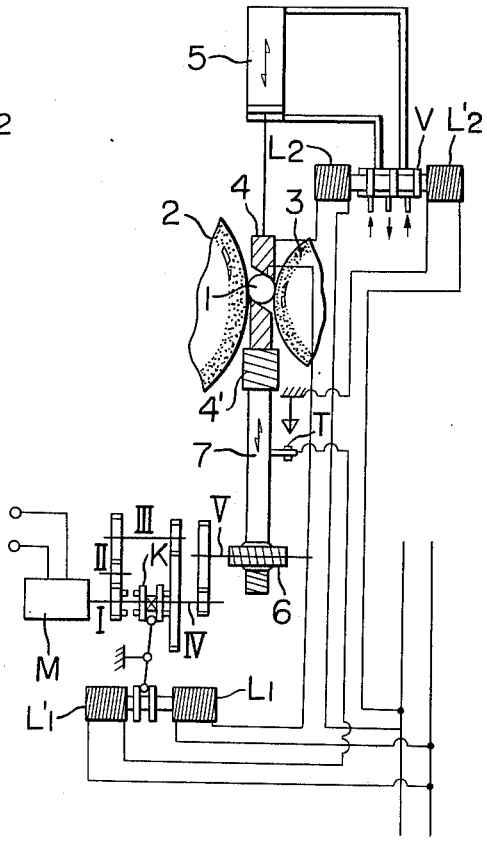

The FIG. 5(*a*), (*b*) shows the system diagram for automatic control of the mechanism as shown in FIG. 4. In the FIGURE, 1 is a workpiece, 2 is a grinding wheel, 3 is a regulating wheel, 4 is a workrest, 4' is a workrest holder, 5 is a motor for driving of the workrest, 6 is a worm wheel for driving the workrest holder, 7 is a cylindrical part of the workrest holder, T is a micro-switch for checking the position of the workrest holder, O is an in-process gauge, M is an electric motor for driving the workrest holder, K is a clutch, V is an exchangeable valve, $L_1$ and $L'_1$ are solenoids for the exchange of the clutch K, $L_2$ and $L'_2$ are solenoids for the exchange of the valve V. (*a*) of FIG. 5 is the system diagram for the description of automatic control using the micro-switch T, which checks the position of the workrest at the end of the grinding of each workpiece. (*b*) is also the system diagram for the description of the automatic control using the in-process gauge which checks the dimension of the diameter of the workpiece at the end of the grinding process.

As shown in FIG. 5, during grinding the depth of cut proceeds with the drive of the workrest holder, and at the end of the grinding process, in the case of (*a*), with the function of the micro-switch T, in the case of (*b*), with the function of the in-process gauge O, the solenoid $L_1$ and $L_2$ acts for the exchange of the clutch K and the valve V, and the workrest and the workrest holder, at the end of the movement begin the upward movement for return.

Then, at the end of the upward movement of the workrest holder, the micro-switch T acts on the solenoid $L'_1$ and $L'_2$ for the exchange of the clutch K and the valve V, so as to begin the downward movement of the workrest and the workrest holder for the grinding of the workpiece.

With regard to the driving of the reciprocative movement of the workrest holder, when the clutch K engages the gear of the shaft IV, the electric motor M drives the shaft I, II, III, IV, V and the worm wheel 6 with gear and worm, and the revolution of the motor decreases about 1/500–1/600 for the driving of the feed movement of the workrest holder in the grinding process. When the clutch K engages the gear of the shaft I the motor M drives the shaft IV, V and the worm wheel 6, and the revolution of the motor decreases about 1/150–1/200. Also, the revolving direction of the motor is changed by the worm wheel for the drive of the upward movement of the workrest holder.

Figure 6A:
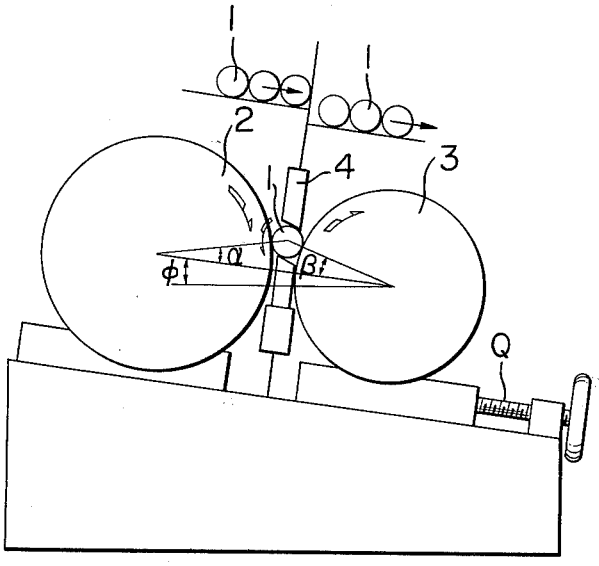
FIGS. 6(*a*), 6(*b*), 6(*c*) is an explanatory view of another embodiment of the centerless grinding machine according to the invention, in which a grinding wheel and a regulating wheel are arranged on the upper surface of a bed which is slightly inclined, in such a manner that the regulating wheel may be positioned slightly below the grinding wheel for the purpose of enhancing the smooth rotation of workpieces at the beginning and the end of centerless grinding.
Figure 6B:
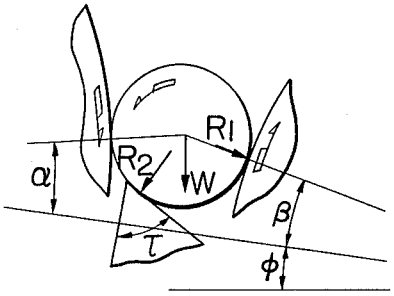
Figure 6C:
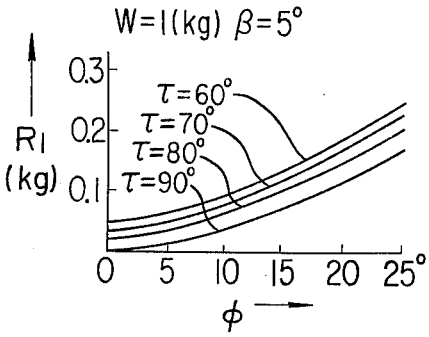

FIG. 6 shows, with the centerless grinding machine of the invention, one practical example, where the regulating wheel is placed slightly under the grinding wheel. As shown in the FIGURE, the line, which connects the centers of the grinding and regulating wheels is declined at the angle $\phi$ to the horizontal line.

In the FIGURE, 1 is a workpiece, 2 is a grinding wheel, 3 is a regulating wheel, 4 is a workrest, and $\alpha$ is the angle between the line connecting the centers of the grinding wheel and regulating wheels and the line connecting the centers of the grinding wheel and the workpiece, B is the angle between the line connecting the centers of the grinding wheel and the regulating wheel and the line connecting the centers of the regulating wheel and the workpiece, $\tau$ is the top angle of the workrest, W is the weight of the workpiece, $R_1$ is the contact pressure between the workpiece and the regulating wheel, $R_2$ is the contact pressure between the workpiece and the workrest, and Q is a screw for the adjustment of the distance between the grinding wheel and the regulating wheel.

In the centerless grinding process, the grinding and the regulating wheels and the workpiece are rotated in the direction as shown by the arrow in FIG. 6. However, in general, the rotation of the workpiece is started at first with the grinding force generated by the depth of cut, and is continued with the grinding force.

Therefore, for the maintenance of the dimensional accuracy and the accuracy of shape of the ground workpiece, it is necessary to maintain the rotation of the workpiece with the slight depth of cut and with the increased driving force of the regulating wheel which accelerates the rotation of the workpiece, and also with the decrease of the frictional force between the workpiece and the workrest with the construction of the centerless grinding machine, the regulating wheel is placed slightly under the grinding wheel, as shown in FIG. 4(*c*), the contact pressure $R_1$ between the workpiece and the regulating wheel is increased with the increase of the angle $\phi$, and the contact pressure $R_2$ between the workpiece and the workrest decreases conversely with the decrease in value of $R_1$.

Therefore, at the beginning of the grinding process, the driving force of the regulating wheel for the workpiece given in the value $\mu R_1$, where $\mu$ is the coefficient of friction between the workpiece and the regulating wheel, obviously increases with the increase of the angle $\phi$. With the selection of the value of the angle $\tau$ of the workrest, on the tendency of the $\tau < 90°$ to reduce the increases, the rotating condition of the workpiece is improved, and in the conventional centerless grinding machine, the value of the angle $\tau$ is suitably selected according to the rotation, the geometric supporting condition of the workpiece in the grinding as well as the stable rotating condition of the workpiece in the grinding.

With the value of the angle $\phi$, in the usual centerless grinding machine, the relation of the rotating condition of the workpiece with the beginning of the grinding for a small depth of cut was recognized as the value of the angle $\tau$. However, as compaired with the selection of the value of the angle $\tau$, it is very difficult to select a suitable value for the angle $\phi$, and the requirement for the smooth rotation of the workpiece at the beginning of the grinding is usually satisfied by the selection of the value of the angle 96. The setting of the angle $\phi$ was not expected except in the case of the grinding of heavy workpiece with a large diameter.

In the centerless grinding of the invention, as described above, it is the object to achieve the grinding of the workpieces previously ground by the conventional in-feed method, or of workpieces, for example the inner races of the ball bearings or the spherical rollers of the roller bearings, which are not precisely ground by conventional centerless grinding methods.

Therefore, the regulating wheel is set against the grinding wheel with the angle $\phi$, as shown in FIG. 6, so as to maintain the smooth rotation of the workpiece at the beginning and the end of the grinding process with a small depth of cut, and to achieve precise grinding of workpieces with a high degree of dimensional and shape accuracy.

Further, with the construction of the centerless grinding machine, as shown in FIG. 6(*a*), the upright common guide way placed on the bed for the reciprocative movements of the workrest and the workrest holder, are inclined to the vertical plane at the angle $\phi$, and therefore, the loading and unloading of the workpiece on the magazine against the workrest is improved, and the adjustment of the distance between the grinding wheel and the regulating wheel with the use of the screw Q is also improved with the elimination of the back-rush of the screw. According to the present invention, it becomes possible to obtain a high performance centerless grinding machine using the tangential feed method with the new method of construction for the mechanism of the drive of the workrest. That is, 1. As shown in FIGS. 1–5, the supporting part for the workpieces is constructed separately from the workrest and the workrest holder. The workrest and the workrest holder are driven individually for the loading, unloading and the feeding movement of the workpiece, so that the idling time of the centerless grinding machine due to the loading and unloading of the workpiece can be reduced to the technically possible minimum value. Also, the rigidity of the workrest is increased with the workrest and the workrest holder in the direction of the tangential feed movement, during the grinding of the workpiece.

2. As a whole, the centerless grinding machine of the invention can be made rigidly and stable, and can be maintained with excellent operational characteristics. That is, for example, as compared with the aforesaid centerless grinding machine made by the NOMOCO CO., bearing heads of the grinding and regulating wheel shafts, and the guide ways of the workrest and the workrest holder are set rigidly on the firm bed of the machine, and also the spindle shafts of the grinding and regulating wheels can be firmly supported on both sides of the spindle shaft with the bearings. The workrest and workrest holder are firmly guided in the direction of the tangential feed movement with the pair of guide posts, which are rigidly fixed on the bed of the machine, close to both sides of the grinding position. During the grinding of the workpiece, the workrest is supported precisely in the direction of the feeding movement by means of the workrest holder which is firmly drived by the screw or the cam. Therefore, by employing the centerless grinding method of the invention, even when the grinding is heavy, for example, the grinding of a forged workpiece with excessive removal of stock, and high speed grinding with the necessary high rigidity are firmly maintained with a high degree of precision and efficiency.

3. In the grinding process with the centerless grinding machine of the invention, the value of the depth of cut, which achieves the dimensional accuracy of the workpieces, is precisely given by the tangential feed movement, which is firmly driven by the cam or screw, and also with a precise control of the feeding movement.

That is, with the tangential feed method, the value of the tangential feed movement is 5–6 times greater than the value of the depth of cut, so that the value of the depth of cut can be measured with 5–6 times greater sensitivity than with the direct measurement of the value of the depth of cut. Also, the control of the feeding movement of the workrest for the control of the depth of cut is easier than the control of the value of the displacement of the grinding or regulating wheel in the case of the in-feed or through-feed method. For the above-mentioned reason, the dimensional accuracy of the workpieces, which are ground by the centerless grinding machine of the invention, is maintained with a high degree of accuracy.

4. In centerless grinding, it is well known that the workpiece are ground in a shape not truly round, that is in the "Gleich-dick". One of the solutions for the "Gleich-dick" is to support the workpiece in a proper geometrical position during the grinding process. For the geometrical supporting position of the workpiece, the supporting height H, shown in FIG. 1, is usually considered, and is usually selected according to the value H = 10–20 mm, which is known as the value, whereby the tendencies to be round or unround are equal. Especially when the value H = 0, the centerless grinding process has the tendency to produce a workpiece ground in the shape of the "Gleich-dick". In such a supporting position, the tendency for a workpiece in the "Gleich-dick" shape to become truly round is zero, so that this supporting position is unsuitable for the grinding of the workpiece with a degree of high roundness.

The centerless grinding of the tangential feed method of the invention is different from that of the tangential feed method of the rotating workrest, whereby the workpiece are not ground while passing the position where H = 0. Moreover, with reference to the selection of the angle $\tau$, in each case, the value of H can be suitably determined for the geometrically optimum supporting positions of the workpieces.

That is, as shown in FIGS. 4 and 5, the geometrically optimum supporting height of the grinding workpiece is more easily set by selecting a position of the microswitch T in the direction of the tangential feed movement, than the case with usual centerless grinding machine, in which the workrest is fixed on the bed of the machine. The setting of the position of the workrest can also be effected by a simple electrical controlling panel. Therefore, according to the centerless grinding machine of the invention, the accuracy of the raundness and the cylindrical shape of the ground workpieces are maintained with a high degree of precision, together with dimensional accuracy.

5. With the centerless grinding machine of the invention, the operation of the machine can be effected automatically. That is, as explained with reference to FIGS. 4 and 5, the workpiece which is fed into the workrest, is automatically loaded in the grinding position, and after the automatic grinding, the ground workpiece is unloaded automatically from the grinding position. In the centerless grinding machine employing the conventional in-feed method, however, it is difficult to effect the automatic loading and unloading of the workpieces to the grinding position, for the centerless grinding of the workpiece, especially for the grinding of workpieces of complicated shape.

According to the invention, as explained in details with regard to FIGS. 1–3, the supporting part of the workpiece is separated into the workrest and the workrest holder, and the workrest and the workrest holder are driven individually for the optimum realization of the loading, unloading and grinding of the workpiece, so that the centerless grinding machine is easily operated with complete automation and decrease in time required for centerless grinding.

Furthermore, according to the construction of the machine, the construction of the magazine is simply built with the feed out of the workpiece, for example, in case of the grinding of the cross pin of the propeller shaft of the motorcar, the workpiece can be suitably arranged on the magazine, so as to feed the workpiece from the rough grinding to the medium and fine grinding machine without rearranging it on the magazine. This is different from the case of the centerless grinding machine mady by the NOMOCO Co., whereby the workpiece fed out from the workrest drops into the basket by self-gravity. According to the invention, the ground workpiece is continuously fed with a simple construction of the magazine between each centerless grinding machine for the rough, medium and fine grinding.

6. Usually in grinding processes using a grinding wheel, with a difference in the stock of removal, the wear of the grinding wheel during the grinding process, there is insufficient rigidity in grinding machine and a slight deformation of the grinding machine due to a rise in temperature. Accordingly, it is very difficult to maintain the same depth of cut for the each workpiece to be ground, though the distance between the centers of the grinding wheel and the workpiece is precisely set. As a result, the dimensional accuracy is not the same for every around workpiece. Therefore, the in-process gauge has so far been after used by the cylindrical grinding machine or the internal grinding machine for the dimensionally precise checking of the workpiece being ground and for the finishing of the grinding process by the stopping of the feed movement for the depth of cut and for the following return of the grinding wheel head.

With regard to the centerless grinding process, the use of the in-process gauge has also been required for many years in order to maintain a high degree of dimensional accuracy in the ground workpiece, and to obtain the minimum dimensional difference in the workpieces. However, in conventional centerless grinding machines, it is very difficult to set the in-process gauge at the approach of the grinding workpiece, because the grinding workpiece keeps contact simultaneously with the grinding and the regulating wheel, and the supporting plane of the workrest in the wedge-shaped space, which is formed by the circumference of the grinding wheel and the regulating wheel.

In the centerless grinding process of the invention, as shown in FIG. 4 and 5, it is easy to apply the in-process gauge to the centerless grinding process. Moreover, by resultant control of the centerless grinding machine, as compared, for example, with the centerless grinding machine using the in-feed method, by which the heavy regulating wheel head is driven by the in-feed movement, it is expected that the control of the movement of the light workrest and workrest holder can be operated correctly under the slight influence of the moment of inertia of the moving parts.

7. In the centerless grinding machine of the invention, as described with reference to FIG. 6, with the setting of the regulating wheel in the slightly lower position against the grinding wheel, it is possible to rotate the workpiece for a small depth of cut, so as to maintain precise centerless grinding for the parts of precision machines. Also, in this construction of the centerless grinding machine, the feeding of the workpiece between the magazine and the workrest, and the automation of the machine are easily improved, and the operation of the machine is also improved with the elimination of the back rush of the screw for the adjustment of the distance between the grinding wheel and the regulating wheel.

8. With the centerless grinding machine, as shown in FIGS. 4 and 5, it is possible to set the driving mechanism of the supporting part of the workpiece, i.e. the workrest and the workrest holder, in the inside space of the machine bed, which is not used in the conventional centerless grinding machines. For the reason as mentioned above, as compared with the centerless grinding machine using the in-feed method, the construction of the machine is simple for the automatic loading and unloading of the workpiece.

Further, in the in-feed method, automatic control using the in-process gauge for the maintenance of the dimensional accuracy of the ground workpiece is difficult because of the complication in the construction of the machine, the cost of production and maintenance. In the centerless grinding machine of the invention, as described above, it is easy to produce a centerless grinding machine using the in-process gauge with a high degree performance, a low cost of production and maintenance.

The various features of the invention have been particularly shown and described, however, it should be obvious to one skilled in the art that modifications may be made therein without departing from the scope of the invention.

I claim:

1. In a centerless grinding machine of tangential feed type including a grinding wheel adapted to rotate under high speed and a regulating wheel adapted to rotate under low speed in the same direction as said grinding wheel, in which said grinding wheel and regulating wheel are provided at the upper surface of a bed, and a work holder is moved in a tangential direction common to both of said grinding wheel and regulating wheel between said grinding wheel and regulating wheel, so as to give depth of cut to a workpiece, said machine characterized by a work holder which is divided into a workrest (4) adapted to move reciprocatively in the tangential direction for loading and unloading workpieces to and from grinding position and a workrest holder (4') adapted to support said workrest during grinding operation and give depth of cut to the workpiece, said workrest and workrest holder being reciprocatively moved under the same cycle by their independent driving mechanisms and adapted to be combined so that the workpiece held within said workrest is given depth of cut by the movement of said workrest holder in the tangential direction, said workrest being separated from said workrest holder upon completion of grinding operation and adapted to be returned upwardly in a short time and, after the workpiece held within said workrest is unloaded and the next workpiece is set, said workrest being moved into grinding position again in a short time, while said workrest holder being returned upwardly to the position to start grinding immediately after grinding operation is finished, said workrest and workrest holder being combined again as said workrest moves into grinding position and at the same time, said workrest holder being moved in the direction to give depth of cut to the workpiece as soon as said workrest holder is returned upwardly, so that the workpiece held within said workrest is given depth of cut as said workrest is moved in the tangential direction, thus giving centerless grinding to the workpiece repeatedly, whereby it becomes possible to provide centerless grinding with high aaccuracy, to shorten the idling time in the centerless grinding machine as well as to fully automatize the machine in an easy manner.

2. A centerless grinding machine as claimed in claim 1, wherein the workrest (4) is operated by a single or double motor constructed of a cylinder and a piston.

3. A centerless grinding machine as claimed in claim 1, wherein the workrest holder (4') is operated by a screw or a cam.

4. A centerless grinding machine as claimed in claim 1, wherein the position of the workrest holder (4') in the direction of the tangential feed movement is checked with a micro-switch which changes the direction of movements of the workrest holder (4') by means of an electromagnetic clutch.

5. A centerless grinding machine as claimed in claim 4, wherein the change of direction of the movements of the workrest (4) which is operated by a motor constructed of a cylinder and a piston is controlled by a check valve which is operated by an electric current from said micro-switch, used for the positioning of the workrest holer (4').

6. A centerless grinding machine as claimed in claim 1, wherein said workrest (4) and workrest holder (4'), which are operated through a micro-switch, are operated under the same cycle.

7. A centerless grinding machine as claimed in claim 1, wherein the operating mechanism of said workrest holder, is constructed of a screw or a cam, an electric motor and a gear box, and, is set inside the bed of the centerless grinding machine.

8. A centerless grinding machine as claimed in claim 1, including common guide posts wherein said workrest (4) and workrest holder (4') are guided by said common guide posts which are set on the bed on both sides of said grinding wheel.

9. A centerless grinding machine as claimed in claim 1, wherein said workrest (4) and workrest holder (4') are operated with an in-process gauge which is set in said workrest (4).

10. A centerless grinding machine as claimed in claim 1, wherein said regulating wheel is placed slightly under said grinding wheel on a line, which connects the centers of said regulating and grinding wheels with an angle $\phi$ from the horizontal line.

11. A centerless grinding machine as claimed in claim 1, wherein a damper is set between said workrest (4) and workrest holer (4').

* * * * *